United States Patent [19]

Chapelot

[11] Patent Number: 4,560,219

[45] Date of Patent: Dec. 24, 1985

[54] WATERPROOF ELECTRICAL CONNECTOR

[75] Inventor: Raymond Chapelot, Lagny sur Marne, France

[73] Assignee: Precision Mecanique Labinal, Bois D'Arcy, France

[21] Appl. No.: 550,183

[22] Filed: Nov. 7, 1983

[30] Foreign Application Priority Data

Nov. 9, 1982 [FR] France ..... 82 18782

[51] Int. Cl.[4] ..... H01R 11/00

[52] U.S. Cl. ..... 339/60 R; 339/94 R

[58] Field of Search ..... 339/59 R, 59 M, 60 R, 339/60 C, 60 M, 61 R, 61 M, 94 R, 94 C

[56] References Cited

U.S. PATENT DOCUMENTS 4,173,349 11/1979 Neale, III ..... 339/94 C
4,214,802 7/1980 Otani et al. ..... 339/60 M

FOREIGN PATENT DOCUMENTS 2115684 7/1972 France .
770307 3/1957 United Kingdom .
960400 6/1964 United Kingdom .
2034131 5/1980 United Kingdom ..... 339/94 C

*Primary Examiner*—Joseph H. McGlynn
*Assistant Examiner*—Paula Austin
*Attorney, Agent, or Firm*—Sander & Greenblum

[57] ABSTRACT

A waterproof electrical connector for connecting electrical conductors. The connector includes male and female electrical contact members which are adapted to be connected to different electrical conductors. In addition, the male and female electrical contact members comprise male and female complementary plugs which are adapted to mate with each other to create an electrical connection. Also provided are male and female elastic, insulating blocks in which the male and female members are respectively embedded. Male and female housings house the male and female blocks, respectively. A first sealing means seals the end of the male and female blocks nearest the electrical connection from the infiltration of water. The first sealing means is pressure-actuated and comprises a concave cup at the end of each block. A second sealing means seals the male and female housings against the infiltration of water therethrough is also provided and it is also pressure-actuated.

32 Claims, 4 Drawing Figures

WATERPROOF ELECTRICAL CONNECTOR

BACKGROUND OF THE INVENTION

1. Field of the Invention

The present invention relates to a waterproof electrical connector.

2. Description of the Prior Art

One primary disadvantage of traditional electrical connectors which connect electrical conductors is that humidity in the air is free to contact the surface of the elements that create the electrical connection, thereby degrading the connection. Thus, there is a need for an electrical connector which is as simple in design as traditional connectors, but which insures that the conductors are completely shielded from humidity, regardless of the conditions under which the connector is operated.

SUMMARY OF THE INVENTION

It is the goal of the present invention to provide an electrical connector having a design that is as simple as traditional connectors, but in which the electrical elements which insure the electrical connection are completely free from humidity, regardless of the conditions under which it is operated.

The connector which achieves this goal in one preferred embodiment, comprises male and female electrical contact members, male and female blocks in which the male and female contact members are, respectively, embedded, and a housing for housing the male and female blocks. The male electrical contact member is adapted to be connected to an electrical conductor, as is the female electrical contact member. In addition, the male and female contact members comprise male and female complementary plugs, respectively, adapted to mate with each other to create an electrical connection. The male and female blocks are composed of flexible, elastic, and insulating waterproof material. The male and female members are so embedded in their respective blocks that the male and female plugs are free to mate with each other.

The housing comprises a male housing and a female housing. The male housing is adapted to receive the male member and the male block, and the female housing is adapted to receive the female member and the female block. The male and female housings are also adapted to mate with each other, and are further provided with an attachment means for attaching them together. Also provided is an insulating wall having an opening therein for receiving the male complementary plug. In one embodiment, this wall is part of the housing.

The attaching means for attaching the male and female housings comprises two hooks on the male housing, each hook having a nose, and two lugs on the female housing. Each lug has an opening therein, parallel to the longitudinal axis of the housing, for receiving one of the hooks. Each hook is adapted to traverse one of the openings so that each nose cooperates with a lug at the edge of the opening in the clip to attach the male and female housings.

The male and female blocks, at a first end thereof, are each provided with a pressure-actuated sealing means. In one embodiment this first end is the end nearest the male and female complementary plugs. This sealing means substantially seals the electrical connection against contact with water when the male complementary plug is inserted into the opening in the wall and is inserted into the female complementary plug, and when both of the pressure-actuated sealing means are pressed against the wall. The sealing means may comprise an elastic cup having a concave cross section. In another embodiment, the cup can have the shape of a portion of a sphere. In any event, when the male and female plugs are pressed together to create the electrical connection, the two pressure-actuated ends of the male and female blocks are compressed and function as suction cups in conjunction with the wall, thereby preventing all infiltration of water or water vapor toward the male and female plugs.

In order to prevent the infiltration of water and water vapor between the wall of the housing and the male and female blocks, both the male and female blocks comprise a plurality of peripheral projections on their lateral wall which project substantially perpendicular to the longitudinal axis of the male and female members. The diameter of the male block when measured through any of these projections is slightly greater than the internal diameter of the male housing. Therefore, because the male member is flexible and elastic, it may be fitted into the slightly smaller male housing. When this is done, the projections very firmly abut the interior wall of the male housing thereby preventing the infiltration of water therethrough.

The male housing further comprises a shoulder and an extension. The extension is connected to the housing by the shoulder. The extension is adapted to engage the female housing by surrounding the female block. The female block further comprises a plurality of projections extending from its lateral wall and projecting substantially perpendicular to the longitudinal axis of the female member. The diameter of the female block when measured through any of these projections is slightly greater than the diameter of the extension so that water and water vapor are prevented from travelling from the wall of the housing to the female block in the same manner as in the male block described above. The shoulder of the male housing is adapted to abut one end of the female housing when the extension engages the female housing.

According to another aspect of the invention, the length of the male block is slightly greater than the length of the male housing. In addition, pressing means are provided for pressing the male block toward the wall to a closed position in which the pressure-actuated sealing means is actuated. A locking means is also provided for locking the male block in this closed position. The pressing means comprises first and second shutters, hinged on opposite lateral walls of the male housing. Each shutter comprises a flap, which is adapted to move from an open position in which the flap is out of contact with the male block to a closed position in which the flap is adapted to press a second end of the male block toward the wall. The flap of the first shutter comprises at least one hook and the flap of the second shutter comprises at least one lug having an opening therein which is adapted to receive the hook for locking the male block in its closed position. The flaps are adapted to press the end of the male block opposite to the end having the pressure-actuated sealing means. In addition, the shutters are located at the end of the male element opposite the end having the extension thereon.

The female housing comprises a casing open at its two ends. One of the ends is adapted to receive the extension from the male housing, while the other end is adapted to contact movable shutters, identical to the movable shutters on the male housing. The female housing comprises a stop at a location intermediate along its length. This stop is adapted to abut a shoulder on the female block when the female block is inserted into the female housing. The female block also comprises a cylindrical part, between the shoulder and one end thereof, and a part having the projections thereon, which is located between the shoulder and the pressure-actuated sealing means. The length of the part of the female block having the projections thereon is slightly greater than the length of the extension. Because of this difference in lengths, the flaps on the first and second shutters, which are hinged on opposite lateral walls of the female housing, will contact a second end of the female block, opposite the first end having pressure-actuated sealing means thereon, and press that sealing means against the wall when the male and female complementary plugs are engaged with each other. The flaps are adapted to move from an open position in which the flaps are out of contact with the second end of the female housing and the male block to a closed position in which the flaps contact the second end of the female block. A locking means is also provided for locking these shutters against the female block in their closed position. The locking means is identical to the locking means described for the flaps on the male housing.

In another embodiment of the invention, the waterproof electrical connector for connecting electrical conductors comprises male and female electrical contact members, male and female blocks having a first end, in which the male and female members are embedded, male and female housings for housing the male and female blocks, respectively, a first sealing means for sealing the first ends of the male and female blocks against the infiltration of water, and a second sealing means for sealing the male and female housings against the infiltration of water therethrough. The male and female electrical contact members are adapted to be connected to an electrical conductor and they comprise male and female complementary plugs, respectively, which are adapted to mate with each other to create an electrical connection. The blocks in which the male and female members are embedded are elastic, flexible and are made of insulating material. In addition, the male and female electrical contact members are so embedded in their respective male and female blocks that the male and female complementary plugs are free to mate with each other when the first ends of the male and female blocks are displaced toward each other. In one embodiment the male block permits the male plug to extend from a first end thereof, and the female member is so embedded in the female block that the male plug may enter the female member through the first end of the female block. In addition, the male and female housings are adapted to mate with each other.

The male housing comprises a wall having an opening therein which is adapted to receive the male plug. The first sealing means comprises first and second pressure-responsive sealing means located, respectively, at the first end of the male and female blocks, for producing a waterproof seal when these first and second pressure-responsive sealing means are pressed against the wall and when the plug is inserted into the opening and into the female plug. The first and second pressure-responsive sealing means each comprise an elastic concave element. In one embodiment, this concave element is in the shape of a portion of a sphere. In another embodiment, an attachment means is provided for attaching the male and female housings together.

The length of the male and female blocks is slightly greater than the length of the male and female housings, respectively. In addition, the male and female housings further comprise first and second pressing means, respectively, for pressing, respectively, the first and second pressure-responsive sealing means into a closed position against the wall when the male and female complementary plugs mate with each other. Also provided is a locking means for locking the first and second pressure-responsive sealing means into a closed position. The first and second pressing means each comprise first and second shutters, hinged on opposite lateral walls of their respective housing. These first and second shutters are adapted to move from an open position in which the shutters are out of contact with the second end of the blocks to a closed position in which the shutters press against the second ends of the the blocks. The second end of the blocks is the end of the block opposite from the first end which has the pressure-responsive sealing means thereon. The locking means comprises two hooks at the end of the first shutter and two lugs having an opening therein on the second shutter. Each hook is adapted to be inserted into one of the openings of the lugs.

The male housing comprises an extension extending from the wall and away from the male block. This extension is adapted to receive a portion of the female block therein. The female housing, in one embodiment, is cylindrical and also comprises a stop at an intermediate location along its length. This stop is adapted to abut a shoulder on the female block when the female block is inserted into the female housing. The female block also comprises first and second parts. The first part is cylindrical and extends from the shoulder to the end opposite the sealing means. The second part extends from the shoulder to the second pressure-responsive sealing means. The length of the second part is slightly greater than the length of the extension. In this way, the pressure-responsive sealing means is pressed against the wall to produce a tight seal when the flaps are locked in the closed position and when the male and female members mate.

The male block comprises a lateral wall and has at least one projection extending therefrom, wherein the width of the male block when measured through said projection is slightly greater than the width of the interior of the male housing. The projection is so shaped that substantially no water can flow through the housing from one side of the projection to the other when the male body is inserted into the male housing. In this way, the projection comprises a second sealing means. In another embodiment, the male housing is substantially cylindrical in shape and the male block comprises a plurality of projections, substantially circular and substantially parallel to each other, and which project substantially perpendicular to the longitudinal axis of the male member. The diameter of the male block when measured through any projection is slightly greater than the internal diameter of the male housing. These plurality of projections comprise the second sealing means.

In this embodiment, the male housing further comprises an extension, extending from the wall, away from the male block and adapted to receive the female block.

The female block comprises at least one projection extending from its lateral wall. The width of the female block when measured through the projection is slightly greater than the interior width of the extension. The projection is so shaped that substantially no water can flow through the housing from one side of the projection to the other when the female body is inserted into the extension. In this way the projection comprises the second sealing means. In another embodiment, the extension is substantially cylindrical in shape and the female block comprises a plurality of projections that are substantially circular and parallel to each other and which project substantially perpendicular to the longitudinal axis of the female member. The diameter of the female block when measured through any of the projections is slightly greater than the internal diameter of the extension.

In another embodiment, the invention comprises a method of forming a waterproof electrical connection between first and second conductors that are adapted to be attached, respectively, to male and female electrical contact members that comprise, respectively, male and female complementary plugs. These male and female complementary plugs are adapted to mate with each other to create an electrical connection. The method comprises embedding the male and female electrical contact members, respectively, in male and female elastic insulating blocks so that the male and female plugs are free to mate with each other through a first end of the male and female blocks. The male and female blocks each comprise a pressure-actuated sealing means at the first end thereof for substantially sealing the first ends of the male and female blocks against contact with water. The method also comprises the step of providing surfaces against which both of the pressure-actuated sealing means can be pressed and actuated when the male and female plugs mate, without interfering with the mating of the plugs. The method also includes a step of then mating the male and female plugs.

In one embodiment, a wall comprises the surfaces against which the pressure-actuated sealing means are pressed and actuated. The wall, in this embodiment, has an opening therein which is adapted to receive the male plug therethrough. The male plug in this embodiment extends from the male block and the method further comprises the step of moving the male plug through the opening in the wall and moving the first ends of the male and female blocks together so that the male plug is inserted into the female plug.

Male and female housings are provided, which are adapted to house, respectively, the male and female blocks. The male and female housings comprise a first end through which the male and female plugs mate, and a second end opposite to the first end of the housing. The method, in this embodiment further includes inserting the male and female blocks into the male and female housings, respectively, and substantially sealing the male and female housings from the infiltration of water from the second end of the housing to the first end of the housing.

The male block comprises a plurality of projections projecting from the lateral wall thereof, and also projecting substantially perpendicular to the longitudinal axis of the male member. The diameter of the male body, when measured through any of the projections, is slightly greater than the internal diameter of the male housing. In this embodiment, the sealing step further comprises inserting the male block into the male housing.

In another embodiment, the male housing comprises an extension thereon, and the female block comprises a plurality of projections projecting therefrom, substantially perpendicular to the longitudinal axis of the female member. The diameter of the female member when measured through any of the projections is slightly greater than the internal diameter of the extension. In this embodiment, the sealing step further comprises mating of the male and female housings by inserting the extension into the first end of the female housing such that the female block is inserted into the extension.

In another embodiment, the male and female blocks are slightly longer than the male and female housings, respectively. In addition, the male and female housings further comprise shutters which are adapted to move from an open to a closed position. In the closed position, the shutters press against a second end of the male and female blocks respectively. This second end is opposite from the first end of the blocks. In addition, the shutters are adapted to be locked into this closed position. The method, in this embodiment, further comprises moving the shutters from the open to the closed position and locking the shutters.

BRIEF DESCRIPTION OF THE DRAWINGS

The invention will now be described in greater detail with reference to particular embodiments which are given only by way of example, and which are illustrated by the accompanying drawings, wherein.

DETAILED DESCRIPTION OF THE PREFERRED EMBODIMENTS

Figure 1:
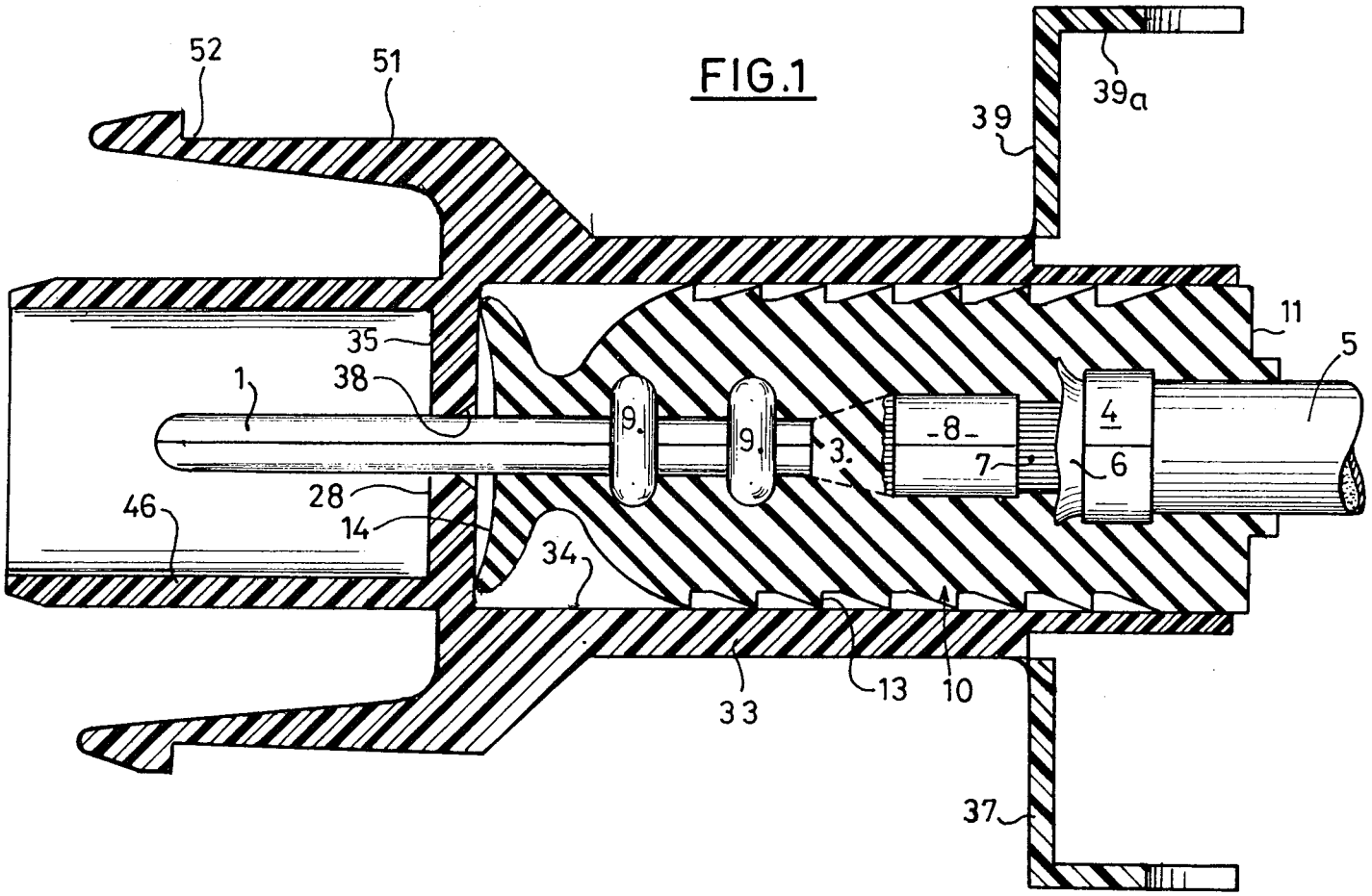
FIG. 1 is a longitudinal cross-sectional view of the male member and of the male housing element, with the shutters being in the open position.
Figure 2:
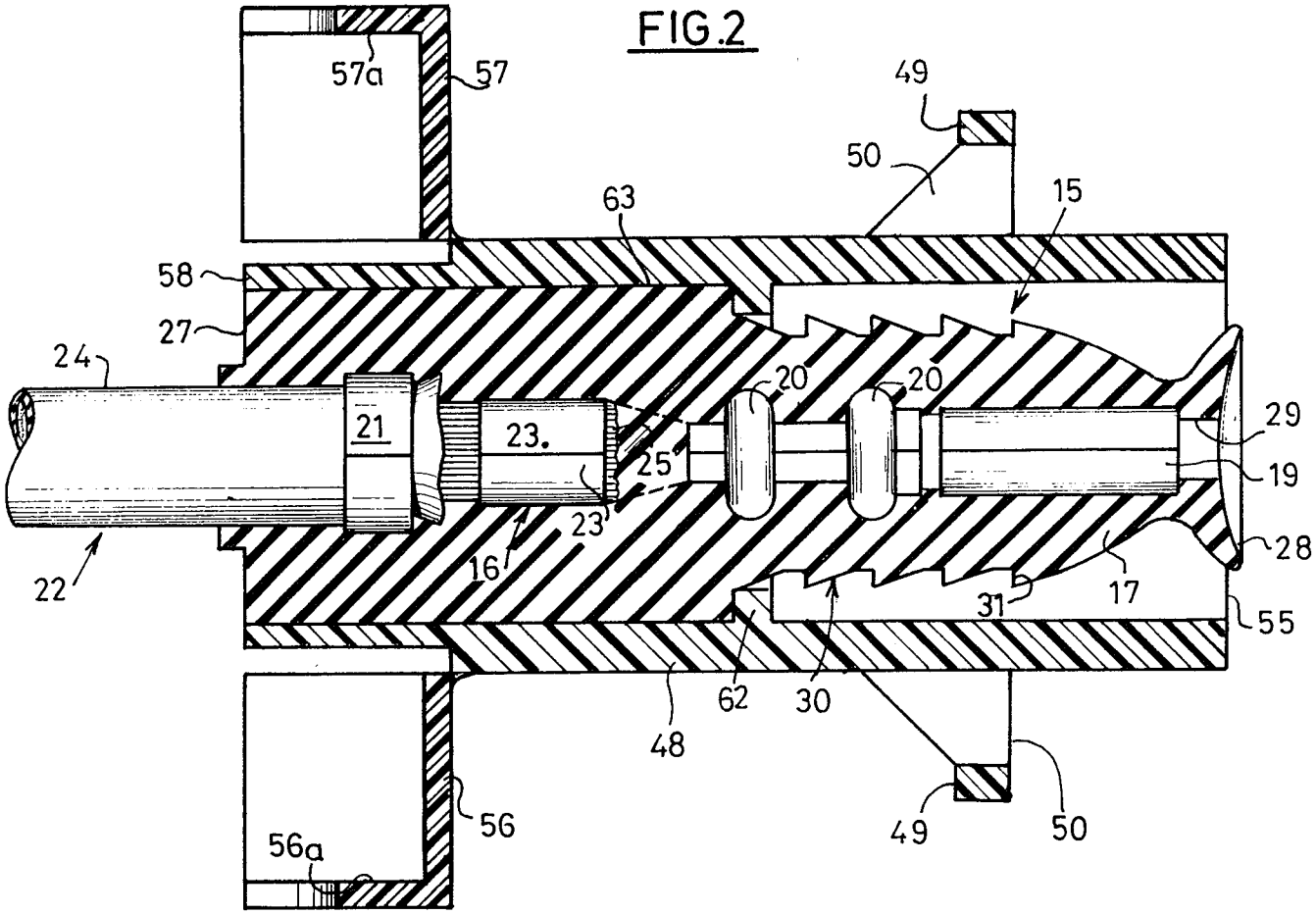
FIG. 2 is a longitudinal cross-sectional view of the female member of the female housing element, with the shutters being in the open position.

The waterproof electrical connector illustrated in the various figures has as its goal to connect different electrical conductors in such a way that the electrical connection is sealed against the deleterious effects of water and humidity. As seen in FIGS. 1 and 2, the waterproof electrical connector comprises a male electrical contact member 1 and a female electrical contact member 15. Male member 1 is adapted to be connected to electrical conductor 5, and female member 15 is adapted to be connected to another electrical conductor 22. The male member 1 is then securely mated with female conductor 15.

As seen in FIG. 1, male member 1 comprises a male complementary plug or pin 2 composed of good electrical conducting material, and which is connected to a body 3. Body 3 comprises clips 4 which grip electrical conductor 5. Electrical conductor 5 comprises an insulating sheath 6 and conductor wire 7. In FIG. 1 the insulating covering 6 has been stripped from the end of conductor 5 to expose conductor wire 7 which is gripped between clips 8 of body 3. Body 3 also comprises beads 9 at the end of pin 2 adjacent clips 8. Beads 9 function to anchor male member 1 in a block 10. Block 10 is composed of flexible, elastic, and insulating material which is molded directly on body 3 so that body 3 is encased in block 10. Because block 10 encases male body 3, it is termed the male block.

As seen in FIG. 2, female member 15 comprises a body 16 located in a block 17 of flexible, elastic and insulating material which is molded directly on body 16. Because female member 15 is encased in block 17, block 17 is termed the female block. Body 16 comprises a tubular conduit 19 adapted to receive pin 2. In addition, body 16 also comprises two beads or pads 20, which are adapted to anchor body 16 in block 17. Clips 21 gripping an electrical conductor 22 are also provided on body 16. Electrical conductor 22 comprises an insulating covering 24 and conductor wire 25 extending therethrough. The covering 24 at the end of conductor 22 has been stripped away to expose bare wire 25, which is gripped by clips 23 of body 16.

Figure 3:
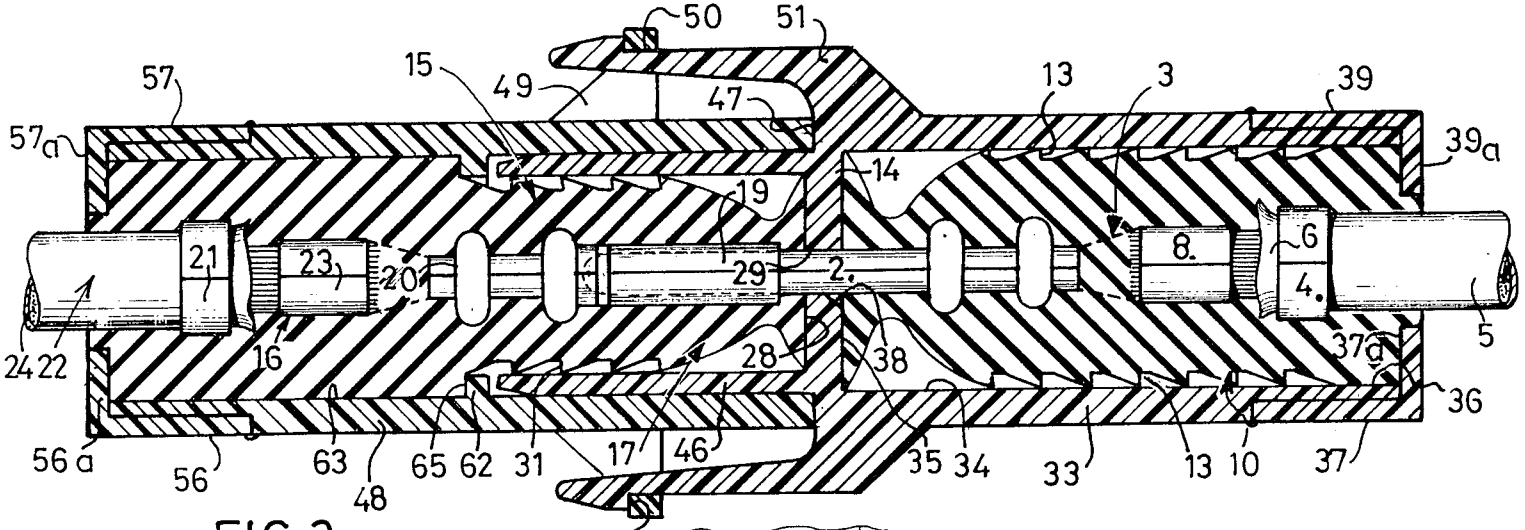
FIG. 3 is a longitudinal cross-sectional view showing the male and female sections when assembled.

Male member 1 and female member 15 are adapted to mate with each other to create an electrical connection. This is accomplished by inserting pin 2 into tubular conduit 19 as seen in FIG. 3. In other words, pin 2 and tubular conduit 19 comprise male and female complementary plugs, respectively, which are adapted to mate with each other to create an electrical connection. It is within the scope of the present invention to use a structure other than pin 2 as the male plug and to use a structure other than a tubular conduit 19 as the female plug.

As seen in FIG. 1, male block 10 comprises one end 11, which extends perpendicular to the longitudinal axis of body 3, a lateral wall 12 with a series of substantially parallel, substantially circular projections 13 thereon which project substantially perpendicularly to the longitudinal axis of body 10, and a pressure-actuated end 14, at the end opposite from end 11. Pressure-actuated end 14 is in the shape of a concave cup, having a concave cross section. In the embodiment shown in FIG. 1, this concave cup has the specific shape of a portion of a sphere, with the concave surface facing away from the free end of pin 2. As will be explained below, end 14 comprises a pressure-actuated sealing means, or a pressure-responsive sealing means for sealing the electrical connection between plug 2 and conduit 19 against contact with water in cooperation with a wall 35. It should be noted that both male block 10 and female block 17 are also composed of waterproof material so that water may not infiltrate through the male and female blocks to the electrical conductor, and that it is within the scope of the invention for end 14 to have a shape other than its partially spherical one.

Female block 17 further comprises a rear end 27 extending substantially perpendicularly to the longitudinal axis of female body 16. Also provided on block 17 is a pressure-actuated end 28, also in the shape of a concave cup, and more specifically in the shape of a portion of a sphere, with its bowed portion facing the rear end 27, and an opening 29 in the central section of end 28. The internal section of opening 29 corresponds to the internal section of tubular conduit or female plug 19. In addition, block 17 is also provided with a lateral wall 30 having a series of substantially circular, substantially parallel projections or steps 31, which are substantially parallel to each other and which project substantially perpendicular to the longitudinal axis of female block 17.

As will be explained below, pressure-actuated end 28 will serve as a pressure-actuated sealing means or a pressure-responsive sealing means for sealing the electrical connection between the male and female plugs against the infiltration of water and humidity in cooperation with wall 35.

Male member 1 and male block 10 are adapted to be lodged or housed in male casing or housing 33. In the embodiment shown in FIG. 1, housing 33 comprises a body of substantially cylindrical shape having a seat 34 therein. Seat 34 comprises a rear wall 35 at one end thereof, and an opening 36 at the other end thereof adapted to receive male block 10.

The internal diameter or width of male housing 33 is slightly less than the diameter or width of male block 10 when measured through any of projections 13, such that projections 13 are firmly pressed against the internal wall of male housing 33 so that substantially no water or humidity can traverse the length of said housing. Of course, it is within the scope of the invention to use only one projection, instead of a plurality of projections, although this would not be as efficient. The projection would have to be shaped so as to permit substantially no water or humidity to flow through housing 33 from one side of the projection to the other. It should be noted that because projections 13 are elastic and flexible that they will deform when male block 10 is pressed into male housing 33 so that male block 10 can be positioned in male housing 33 even though block 10 is of slightly greater diameter than housing 33.

Rear wall 35 has a central opening 38 therein which is adapted to receive pin 2. As can be seen from FIG. 1, pin 2 extends from male block 10 through opening 38 so that it can mate with plug 19 as will be described below.

Seat 34 and male housing 33 have a length that is slightly less than the length of male block 10. This difference in the lengths of these two elements is provided so that block 10 may be easily pressed by a pressing means toward wall 35 into a closed position so that end 14 will function as a suction cup against wall 35 to seal pin 2 against the infiltration of water and moisture. In addition, a locking means will be provided to lock block 10 in this closed position. It is preferable that the difference in length between male block 10 and seat 34 (and between female block 17 and housing 48) be substantially equal to the distance from the tip of the pressure actuated end 14 to the center of the concave portion of end 14 when measured along the longitudinal axis of block 10. In this way, when male body 10 is pressed from its open position seen in FIG. 1 to its closed position seen in FIG. 3, even the central concave portion of end 14 will be firmly pressed against wall 35. The means which press male block 10 toward wall 35 comprises, as seen in FIGS. 1 and 3, two shutters 37 and 39 which are hinged on opposite ends of the lateral wall of male housing 33. Shutters 37 and 39 comprise, respectively, flaps 37*a* and 39*a* which are adapted to move from an open position, seen in FIG. 1, in which they are out of contact with rear end 11 of block 10 to a closed position in which they contact rear end 11 of block 10 end to push block 10 into seat 34 toward wall 35, thereby pressing pressure-actuated end 14 against rear wall 35. When this occurs, block 10 moves from its open position seen in FIG. 1 to its closed position seen in FIG. 3 and end 14 becomes actuated and functions as a suction cup.

Figure 4:
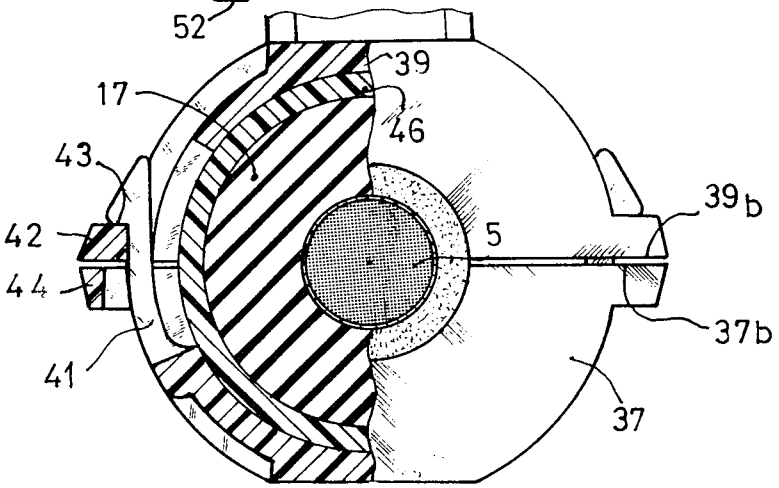
FIG. 4 is a partially cut-away rear view of the male member.

Shutter 37 comprises, as can be seen in FIG. 4, two lateral hooks 41. Flap 39 comprises two lateral lugs 42 having openings therein which are adapted to receive hooks 41. Each hook is adapted to be inserted into one of the openings in the lugs and the end of each hook 41 cooperates with an edge of the lug near the opening to insure the locking of the shutters. In addition, shutter 37 comprises two shoulders 44 which bear against lugs 42.

Housing element 33 also comprises at rear end 35 a cylindrical extension 46, extending from back wall 35 and away from male body 10. Extension 46 is connected to male housing 33 by shoulder 47, and is adapted to engage a complementary female housing 48, which houses female element 15 in female block 17.

Female housing 48 comprises two lateral lugs 49 extending from opposite sides of female housing 48. Preferably, lateral lugs 49 are off-set 180° from each other. Lugs 49 have openings 50 therein which are adapted to receive corresponding hooks 51 of male housing 33. Hooks 51 include noses 52 which are adapted to cooperate with the rims of the corresponding openings 50 to insure the attachment of male housing 33 and female housing 48. In other words, lugs 49 and hooks 51 comprise the attachment means for attaching the male housing to the female housing.

Female housing 48 has two ends, 55 and 58. Housing 48 is open at end 55, while end 58 is provided with two shutters 56 and 57 which function as the pressing and locking means in a similar fashion to shutters 37 and 39 on male housing 33. Shutters 56 and 57 are adapted to press female block 17 from its open position seen in FIG. 2 to its closed position in FIG. 3 and are adapted to lock female block 17 in that closed position. Flaps 56 and 57 are hinged on opposite sides of the lateral wall of female housing 48. Shutters 56 and 57 comprise, respectively, flaps **56*a* and 57*a* which cooperate with and contact end 27 of block 17 when they are moved from their open to their closed position. Shutters 56 and 57 lock in the same manner as shutters 37 and 39. In other words, shutter 56 comprises hooks and shutter 57** comprises lugs having openings therein for receiving the hooks to lock the flaps in the closed position.

Female housing 48 also comprises an annular shoulder 62 located at an intermediate point along its length. This shoulder 62 is adapted to abut a stop or shoulder 65 of female block 17 when female block 17 is inserted into female housing 48 for normal use of the connector. Block 17 comprises two parts: a substantially cylindrical part 63, extending between end 27 and shoulder 65 and which is adapted to cooperate with the internal portion of female housing 48 between shoulder 62 and end 58, and a second part having projections 31 thereon, extending from shoulder 65 to end 28. Part 63 is connected to the part containing projections 31 by shoulder 65. Projections 31 are substantially circular and parallel to each other and project substantially perpendicular to the longitudinal axis of female block 17. The diameter or width of block 17 when measured through any of projections 31 is preferably, slightly greater than the internal diameter of extension 46.

When male housing 33 and female housing 48 are attached to each other, extension 46 is inserted into end 55 of female housing 48. In a similar fashion to the action of projections 13 on male block 10 in male housing 33, projections 31 on female block 17 firmly abut the inner walls of extension 46 so as to form a waterproof seal for preventing water or humidity from travelling the length of projection 46. It is within the scope of the invention to, of course, use only one projection that is so configured that it prevents water or humidity from passing through extension 46 from one side to the other along the length of extension 46.

The length of that portion of female block 17 between shoulder 65 and end 28 is preferably made slightly greater than the length of that portion of female housing 48 between shoulder 62 and the edge of opening 55. In this way, when male housing 33 is attached to female housing 48 and flaps 56 and 57 are placed in their closed position, pressure-actuated end 28 will be pressed against one end of wall 35 and will function as a suction cup to prevent the infiltration of water and humidity to pin 2 and conduit 19.

The assembly of the device will now be described. First, male block 10 is inserted into male housing 33 and female block 17 is inserted into female housing 48. Because of the respective diameters of male block 10 and male housing 33, and female block 17 and housing 48, male block 10 is held in housing 33 so that the infiltration of water along the length of male housing 33 is prevented. Next, shutters 37 and 39 are moved from their opening position as seen in FIG. 1, to their closed position as seen in FIG. 3 and flaps **37*a* and 39*a* are locked. In addition, shutters 56 and 57 on female housing 48 are similarly moved from their open position as seen in FIG. 2 to their closed position seen in FIG. 3 and they are locked in the closed position also. Shutters 37 and 39 act to push pressure-actuated end 14 against wall 35 so that it functions as a suction cup and prevents all water or humidity from reaching that portion of pin 2 in male housing 33**.

Next, male housing 33 is attached to female housing 48 by the engaging of hooks 51 into openings 50 of lugs 49. When this occurs, extension 46 is thrust into female housing 48. As this occurs, first, pressure-actuated end 28 becomes compressed against wall 35 and also functions as a suction cup to prevent pin 2 and conduit 19 from becoming infiltrated with water or water vapor, and second, because of the respective diameters of female block 17 and extension 46, that portion of female block 17 having projections 31 thereon is lodged in extension 46 so as to prevent all water vapor and water from traversing the length of extension 46. During the assembly of female housing member 48 and male housing 33 the electrical connection between male member 1 and female member 15 is made by the engagement of pin 2 in tubular conduit 19. Pin 2, therefore traverses openings 38 and 29 to make this connection. The resulting assembled waterproof electrical connector is seen in FIG. 3.

Of course, the invention is not limited to the embodiments described herein. It is within the scope of the invention to make various modifications. The invention is only limited in scope by the claims.

What is claimed is:

1. A waterproof electrical connector for connecting electrical conductors, comprising:

(a) male electrical contact member adapted to be connected to an electrical conductor;

(b) female electrical contact member adapted to be connected to an electrical conductor, said male and female electrical contact members comprising a male and a female complementary plug respectively, adapted to mate with each other to create an electrical connection;

(c) insulating wall having an opening therein adapted to receive said male complementary plug;

(d) male block of insulating material in which said male electrical contact member is embedded; and (e) female block of insulating material in which said female electrical contact member is embedded; wherein said male and female members are embedded in their respective blocks so that said male and female plugs are free to mate with each other, each of said blocks comprising a pressure-actuated sealing means at a first end of said block for substantially sealing said electrical connection against contact with water when said male complementary plug is inserted into said opening and into said female complementary plug and both of said sealing means are pressed against said wall, wherein said pressure-actuated sealing means comprises an elastic cup having a concave cross section.

2. The connector defined by claim 1 wherein said cup has the shape of a portion of a sphere.

3. The connector defined by claim 1 wherein said first end of said male and female blocks is the end nearest said male and female plugs, respectively, and wherein said connector further comprises:

(f) a housing, wherein said wall is part of said housing and said housing further comprises:

(i) a male housing adapted to receive said male block;

(ii) a female housing adapted to receive said female block and adapted to mate with said male housing; and (iii) an attachment means for attaching said male and female housings to each other.

4. The connector defined by claim 3 wherein said attachment means comprises two hooks on said male housing each having a nose thereon and two lugs on said female housing, each having an opening therein parallel to the longitudinal axis of said housing and adapted to receive one of said hooks, each hook being adapted to traverse one of said openings so that said each nose cooperates with the edge of said opening.

5. The connector defined by claim 3 wherein said male block is elastic and flexible further comprises: a plurality of projections on a lateral wall of said male block, projecting substantially perpendicular to the longitudinal axis of said male member, wherein the diameter of said male block when measured through any of said projections is slightly greater than the internal diameter of said male housing.

6. The connector defined by claim 5 wherein said female block is elastic and flexible and said male housing further comprises a shoulder and an extension, said extensions being connected to said housing by said shoulder, and wherein said female block comprises a plurality of projections extending from a lateral wall thereof, and projecting substantially perpendicular to the longitudinal axis of said female member, wherein the diameter of said female block when measured through any of said projections is slightly greater than the internal diameter of said extension, wherein said extension is adapted to engage said female housing by surrounding said female block and said shoulder is adapted to abut one end of said female housing when said extension engages said female housing.

7. The connector defined by claim 6 wherein the length of said male block is slightly greater than the length of said male housing, and said male housing further comprises:

(i) pressing means for pressing said male block toward said wall to a closed position in which said pressure-actuated sealing means is actuated; and (ii) locking means for locking said male block in said closed position.

8. The connector defined by claim 7 wherein said male housing further comprises lateral walls and said pressing means comprises first and second shutters, hinged on opposite lateral walls of said male housing, wherein each shutter comprises a flap, adapted to move from an open position in which said flap is out of contact with said male block to a closed position in which said flap is adapted to press said a second end of said male block toward said wall, wherein said flap of said first shutter comprises at least one hook, and said flange of said second shutter comprises at least one lug having an opening therein adapted to receive said hook for locking said male block in said closed position.

9. The connector as defined by claim 7 wherein said female housing comprises two open ends and a shoulder therebetween wherein one of said open ends is adapted to receive said male extension, wherein said female block comprises a cylindrical part, between said female shoulder and one end of said female housing and a part having projections thereon, between said female shoulder and said pressure-actuated sealing means, wherein the length of said part having projections thereon is slightly greater than the length of said male extension.

10. The connector defined by claim 9 wherein said female housing has lateral walls, and said female housing further comprises first and second shutters, hinged on opposite lateral walls of said female housing, wherein each shutter comprises a flap, adapted to travel from an open position, in which the flap is out of contact with the other end of said female housing and a second end of said block opposite said pressure-actuated sealing means, to a closed position in which said flap contacts the other end of said female housing and said second end of said female block.

11. The connector defined by claim 10 wherein said female housing further comprises a locking means for locking said shutters against said other end of said female housing.

12. A waterproof electrical connector for connecting electrical conductors, comprising:

(a) male electrical contact member adapted to be connected to an electrical conductor;

(b) female electrical contact member adapted to be connected to an electrical conductor, said male and female contact members comprising male and female complementary plugs, respectively, adapted to mate with each other to create an electrical connection;

(c) male elastic, insulating block in which said male electrical contact member is embedded;

(d) female elastic, insulating block in which said female electrical contact member is embedded, wherein said male and female electrical contact members are so embedded in their respective male and female blocks that said male and female complementary plugs are free to mate with each other when first ends of said male and female blocks are displaced toward each other;

(e) male housing for housing said male block;

(f) female housing for housing said female block and adapted to mate with said male housing;

(g) first sealing means for sealing said first ends of said male and female blocks against infiltration of water; and (h) second sealing means for sealing said male and female housing against the infiltration of water therethrough, wherein said male housing comprises a wall having an opening therein adapted to receive said male plug, and wherein said first sealing means comprises first and second pressure-responsive sealing means located, respectively, at said first end of said male and female blocks for producing a waterproof seal of said first ends of said male and female blocks against said wall when said first and second pressure-responsive sealing means are pressed against said wall and when said male plug is inserted into said opening and into said female plug, wherein said first and second pressure-responsive sealing means each comprise an elastic concave element.

13. The connector defined by claim 12 wherein said concave element is in the shape of a portion of a sphere.

14. The connector defined by claim 13 further comprising an attachment means for attaching said male and female housings together.

15. The connector defined by claim 12 wherein the length of said male and female blocks is slightly greater than the length of said male and female housings, respectively, and said male and female housings further comprise:

(i) first and second pressing means, respectively, for pressing, respectively, said first and second pressure-responsive sealing means into a closed position against said wall when said male and female complementary plugs mate with each other; and (ii) locking means for locking said first and second pressure-responsive sealing means into a closed position.

16. The connector defined by claim 15 wherein said male and female blocks have a second end opposite from said first end and wherein said male and female housings each comprise lateral walls opposite each other and said first and second pressing means each comprise first and second shutters, hinged on opposite lateral walls of their respective housing, and adapted to move from an open position, in which said shutters are out of contact with said second end of said blocks, to a closed position in which said shutters contact said second end of said blocks.

17. The connector defined by claim 11 wherein said locking means comprises two hooks at the end of said first shutter, and two lugs, each having an opening therein, on said second shutter, wherein each hook is adapted to be inserted into one opening in one of said lugs.

18. The connector defined by claim 16 wherein said male housing comprises an extension, extending from said wall away from said male block, and adapted to receive a portion of said female block therein.

19. The connector defined by claim 18 wherein said female housing is cylindrical, and wherein said female block comprises a shoulder and said female housing comprises a stop at an intermediate location along its length, wherein said stop is adapted to abut said shoulder when said female block is inserted in said female housing, and wherein said female block comprises first and second parts, said first part being cylindrical and extending from said shoulder to said second end of said female housing, and said second part extending from said shoulder to said second pressure-responsive sealing means, wherein the length of said second part of said female block is slightly greater than the length of said extension.

20. The connector defined by claim 12 wherein said male block comprises a lateral wall and at least one projection extending from said lateral wall, wherein the width of said male block when measured through said projection is slightly greater than the width of the interior of said male housing wherein said projection is so shaped and positioned that substantially no water can flow through said housing from one side of said projection to the other side thereof when said male body is inserted into said male housing, whereby said projection comprises said second sealing means.

21. The connector defined by claim 20 wherein said male housing is substantially cylindrical in shape and said male block comprises a plurality of projections, substantially circular and substantially parallel to each other and projecting substantially perpendicular to the longitudinal axis of said male member and wherein the diameter of said male block when measured through any of said projections is slightly greater than the internal diameter of said male housing, whereby said plurality of projections comprise said second sealing means.

22. The connector defined by claim 21 wherein said female block comprises a lateral wall and wherein said male housing further comprises an extension adapted to receive said female block and extending from said wall and away from said male block, and wherein said female block comprises at least one projection extending from said lateral wall and wherein the width of said female block when measured through said projection is slightly greater than the interior width of said extension, wherein said projection is so shaped and positioned that substantially no water can flow through said housing from one side of said projection to the other side thereof when said female body is inserted into said extension, whereby said projection comprises said second sealing means.

23. The connector defined by claim 21 wherein said extension is substantially cylindrical in shape and said female block comprises a plurality of projections that are substantially circular and substantially parallel to each other and which project substantially perpendicular to the longitudinal axis of said female member and wherein the diameter of said female block when measured through any of said projections is slightly greater than the internal diameter of said extension, whereby said plurality of projections comprise said second sealing means.

24. A method of forming a waterproof electrical connection between first and second conductors that are adapted to be attached, respectively, to male and female electrical contact members that comprise, respectively, male and female complementary plugs adapted to mate with each other to create an electrical connection, wherein said method comprises:

(a) embedding said male and female electrical contact members, respectively, in male and female elastic insulating blocks so that said male and female plugs are free to mate with each other, through a first end of said male and female blocks, wherein said male and female blocks each comprise a pressure-actuated sealing means comprising an elastic concave element at the first end thereof for substantially sealing said first ends of said male and female blocks against contact with water;

(b) pressing said elastic concave elements against opposite surfaces of a wall to form a waterproof seal of said first ends of said male and female blocks with said wall without interfering with said mating of said plugs; and (c) mating said male and female plugs.

25. The method defined by claim 24 wherein a wall comprises said surfaces and wherein said wall has an opening therein adapted to receive said male plug therethrough, and wherein said male plug extends from said male block, and wherein said method further comprises:

(d) inserting said male plug through said opening in said wall; and (e) moving said first ends of said male and female blocks together so that said male plug is inserted into said female plug.

26. The method defined by claim 25 wherein male and female housings are adapted to house, respectively, said male and female blocks, and wherein said male and female housings comprise a first end through which said male and female plugs mate and a second end opposite said first end, and wherein said method further comprises:

(f) inserting said male and female blocks into said male and female housings, respectively; and (g) substantially sealing said male and female housings from the infiltration of water from said second end to said first end.

27. The method of claim 26 wherein said male block comprises a plurality of projections projecting from a lateral wall thereof and substantially perpendicular to the longitudinal axis of said male member, wherein the diameter of said male block when measured through any of said projections is slightly greater than the internal diameter of said male housing, wherein said sealing step comprises:

(h) inserting said male block into said male housing.

28. The method of claim 26 wherein said male housing comprises an extension thereon, and wherein said female block comprises a plurality of projections projecting therefrom, substantially perpendicular to the longitudinal axis of said female member, and wherein the diameter of the female block when measured through any of said projections is slightly greater than the internal diameter of said extension, wherein said sealing step further comprises:

(i) mating said male and female housings by inserting said extension into said first end of said female housing such that said female block is inserted into said extension.

29. The method of claim 26 wherein said male and female blocks are slightly longer than said male and female housings, respectively, and said male and female housings further comprise shutters adapted to move from an open to a closed position in which said shutters press against a second end of said male and female blocks, respectively, and are adapted to be locked into said closed position, wherein said method further comprises:

(j) moving said shutters from said open to said closed position; and (k) locking said shutters.

30. A waterproof electrical connector for connecting electrical conductors, comprising:

(a) male electrical contact member adapted to be connected to an electrical conductor;

(b) female electrical contact member adapted to female electrical contact members comprising a male and a female complementary plug respectively, adapted to mate with each other to create an electrical connection;

(c) insulating wall having an opening therein adapted to receive said male complementary plug;

(d) male block of insulating material in which said male electrical contact member is embedded; and (e) female block of insulating material in which said female electrical contact member is embedded, wherein said male and female members are embedded in their respective blocks so that said male and female plugs are free to mate with each other, each of said blocks comprising a pressure-actuated sealing means at a first end of said block for substantially sealing said electrical connection against contact with water when said male complementary plug is inserted into said opening and into said female complementary plug and both of said sealing means are pressed against said wall, wherein said first end of said male and female blocks is the end nearest said male and female plugs, respectively, and wherein said connector further comprises:

(f) a housing, wherein said wall is part of said housing and said housing further comprises:

(i) a male housing adapted to receive said male block;

(ii) a female housing adapted to receive said female block and adapted to mate with said male housing; and (iii) an attachment means for attaching said first and second elements to each other, wherein at least one of said male and female housings further comprise:

(i) pressing means for pressing at least one of said male and female blocks toward said wall to a closed position in which said pressure-actuated sealing means is actuated; and (ii) locking means for locking at least one of said male and female blocks in said closed position, wherein at least one of said male and female housings further comprises lateral walls and said pressing means comprises first and second shutters, hinged on opposite lateral walls of said at least one of said male and female housings, wherein each shutter comprises a flap, adapted to move from an open position in which said flap is out of contact with said at least one of said male and female blocks in at least one of said male and female housings to a closed position in which said flap is adapted to press a second end of said at least one of said male and female blocks in said at least one of said male and female housing toward said wall, wherein said flap of said first shutter comprises at least one hook, and said second shutter comprises at least one lug having an opening therein adapted to receive said hook for locking said at least one of said male and female housings in said closed position.

31. A waterproof electrical connector for connecting electrical conductors, comprising:

(a) male electrical contact member adapted to be connected to an electrical conductor;

(b) female electrical contact member adapted to be connected to an electrical conductor said male and female contact members comprising male and female complementary plugs, respectively, adapted to mate with each other to create an electrical connection;

(c) male elastic, insulating block in which said male electrical contact member is embedded;

(d) female elastic insulating block in which said female electrical contact member is embedded, wherein said male and female electrical contact members are so embedded in their respective male and female blocks that said male and female complementary plugs are free to mate with each other when first ends of said male and female blocks are displaced toward each other;

(e) male housing for housing said male block;

(f) female housing for housing said female block and adapted to mate with said male housing:

(g) first sealing means for sealing said first ends of said male and female blocks against infiltration of water;

(h) second sealing means for sealing said male and female housing against the infiltration of water therethrough;

(i) a wall wherein at least one of said male and female housings further comprise:

pressing means, for pressing one of said first and second pressure-responsive sealing means into a closed position against said wall when said male and female complementary plugs mate with each other; and locking means for locking one of said first and second pressure-responsive sealing means into a closed position, wherein at least one of the said male and female blocks have a second end opposite from said first end and wherein at least one of said male and female housings comprise lateral walls opposite each other and said pressing means comprises first and second shutters, hinged on opposite lateral walls of at least one of said male and female housings, and adapted to move from an open position, in which said shutters are out of contact with said second end of at least one of said male and female blocks, to a closed position in which said shutters contact said second end of said at least one of said male and female blocks.

32. A method of forming a waterproof electrical connection between first and second conductors that are adapted to be attached, respectively, to male and female electrical contact members that comprise, respectively, male and female complementary plugs adapted to mate with each other to create an electrical connection, wherein said method comprises the steps of:

(a) embedding said male and female electrical contact members respectively, in male and female electrical insulating blocks so that said male and female plugs are free to mate with each other, through a first end of said male and female blocks, wherein said male and female blocks each comprise a pressure-actuated sealing means at the first end thereof for substantially sealing said first ends of said male and female blocks against contact with water;

(b) providing a wall against which both of said pressure-actuated sealing means can be pressed and actuated when said male and female plugs mate, without interfering with said mating of said plugs;

(c) mating said male and female plugs, wherein said male and female blocks are slightly longer than said male and female housings, respectively, and said male and female housings further comprise shutters adapted to move from an open to a closed position in which said shutters press against a second end of said male and female blocks, respectively, and are adapted to be locked into said closed position, wherein said method further comprises:

(d) moving said shutters from said open to said closed position; and (e) locking said shutters, thereby pressing said pressure-actuated sealing means against opposite surface of said wall to form a waterproof seal of said first ends of said male and female blocks with said wall.

* * * * *